US008122737B2

(12) United States Patent
Nuiding

(10) Patent No.: US 8,122,737 B2
(45) Date of Patent: Feb. 28, 2012

(54) REFRIGERATING DEVICE COMPRISING TUBULAR EVAPORATORS

(75) Inventor: Wolfgang Nuiding, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 777 days.

(21) Appl. No.: 12/225,946

(22) PCT Filed: Mar. 12, 2007

(86) PCT No.: PCT/EP2007/052291

§ 371 (c)(1),
(2), (4) Date: Oct. 3, 2008

(87) PCT Pub. No.: WO2007/115877

PCT Pub. Date: Oct. 18, 2007

(65) Prior Publication Data

US 2009/0120125 A1 May 14, 2009

(30) Foreign Application Priority Data

Apr. 5, 2006 (DE) ..... 20 2006 005 551 U

(51) Int. Cl.
*F25B 39/02* (2006.01)

(52) U.S. Cl. ..... 62/515; 62/527

(58) Field of Classification Search ..... 62/515, 62/516, 513, 527, 524, 526; 165/108, 158
See application file for complete search history.

(56) References Cited

U.S. PATENT DOCUMENTS

| | | | | | |
|---|---|---|---|---|---|
| 1,995,167 | A | | 3/1935 | Battles | |
| 2,118,637 | A | | 5/1938 | Atchison | |
| 2,292,803 | A | | 8/1942 | Steenstrup | |
| 2,371,215 | A | | 3/1945 | Benson | |
| 2,730,872 | A | | 1/1956 | Hall | |
| 2,827,774 | A | | 3/1958 | Dunkelman | |
| 4,171,622 | A | * | 10/1979 | Yamaguchi et al. | 62/160 |
| 4,187,690 | A | * | 2/1980 | Lindahl | 62/138 |
| 4,291,546 | A | * | 9/1981 | Rodth | 62/398 |
| 4,823,561 | A | * | 4/1989 | Medlock | 62/513 |
| 4,995,245 | A | * | 2/1991 | Chang | 62/515 |
| 4,995,453 | A | * | 2/1991 | Bartlett | 165/150 |
| 5,031,411 | A | * | 7/1991 | Gehring et al. | 62/93 |
| 5,031,417 | A | * | 7/1991 | Chang | 62/347 |
| 5,101,884 | A | * | 4/1992 | Leidinger | 165/41 |
| 6,370,901 | B1 | * | 4/2002 | Tso | 62/277 |
| 2003/0051501 | A1 | | 3/2003 | Matsushima et al. | |

FOREIGN PATENT DOCUMENTS

DE 1 299 007 7/1969

(Continued)

OTHER PUBLICATIONS

International Search Report PCT/EP2007/052291.

*Primary Examiner* — Mohammad Ali
(74) *Attorney, Agent, or Firm* — James E. Howard; Andre Pallapies

(57) ABSTRACT

A refrigerating device comprising a tubular evaporator which is connected to a compressor by means of a suction line. A coolant pipe of the tubular evaporator forms a plurality of serially connected tubular loops and one ascending outlet tube connecting the tubular loop that lies the furthest downstream to the suction pipe. The tubular loops have a course that ascends in the direction of the flow of the coolant for a distance that corresponds at least to the length of the outlet tube.

9 Claims, 1 Drawing Sheet

FOREIGN PATENT DOCUMENTS

| | | |
|---|---|---|
| DE | 37 03 902 | 8/1988 |
| JP | 10-19417 | 1/1998 |
| SU | 1740916 A1 | 6/1992 |
| WO | WO 2005/098330 | 10/2005 |

* cited by examiner

REFRIGERATING DEVICE COMPRISING TUBULAR EVAPORATORS

BACKGROUND OF THE INVENTION

The present invention relates to a refrigerating device, in which an internal refrigerating compartment is cooled by a tubular evaporator through which coolant circulated by a compressor flows and which features a carrier plate and a tubular pipe arranged in contact with it so as to conduct heat. The tubular evaporator which is in close thermal contact with the internal refrigerating compartment is thermally screened from the environment by an insulation layer. The compressor is arranged outside the insulating layer and feeds compressed coolant to the evaporator at ambient temperature. As it passes a choke point of the evaporator the coolant is relaxed to a low pressure, which reduces the boiling temperature of the coolant to a value well below that of the ambient temperature. The vaporization of the coolant resulting from this causes the inner compartment to cool down. Gaseous coolant is sucked out of the compressor via a suction line.

With Rollbond evaporators which in general are constructed from two metal plates bonded together, of which in one there is embodied a serpentine coolant line, in general a collector is formed in the evaporator adjacent to the downstream end of the coolant line, which during an idle phase of the compressor traps unvaporized coolant and in this way prevents it being pushed out of the evaporator and into the suction line by coolant evaporating further upstream in the line. To also provide such a collector for a tubular evaporator is complex and expensive, since to do this it is necessary to tightly join together a number of tube sections with different internal widths. Instead of this, with conventional tubular evaporators an ascending outlet tube is frequently arranged directly upstream from the suction tube. While this outlet tube is not completely filled with liquid coolant, so that gaseous coolant can enter at the upstream, lower end of the outlet pipe, bubbles of the gaseous coolant can rise up through any liquid coolant which may possibly be present in the tube. If however the amount of coolant collected at the downstream end of the evaporator is greater than the ability of the outlet tube to accommodate it, liquid coolant gets into the suction line and cools this outside the insulation layer. On the one hand this results in a low thermal efficiency of the refrigerating device, on the other condensation water which precipitates on the outside of the suction line can result in damage to the appliance or can penetrate into the insulation layer and thereby adversely affect its insulation capabilities. To counter this danger, the amount of coolant in the refrigerating circuit of a refrigerating device is currently restricted in order to prevent sufficient liquid coolant from collecting so as to cause the outlet pipe to overflow. Such a restriction can however also adversely affect the efficiency of the refrigerating device.

BRIEF SUMMARY OF THE INVENTION

The object of the present invention is to create a refrigerating device with a tubular evaporator in which, despite more generous filling with coolant, the danger of overflow of the outlet tube is avoided.

The invention achieves this object by, with a refrigerating device with a tubular evaporator, which is connected via a suction line to a compressor and in which a coolant tube forms a plurality of serially-connected tubular loops and an ascending outlet tube connecting the loop of the tubular loops located furthest downstream to the suction line, instead of a conventional horizontal run of straight tube sections of the individual tubular loops, an ascending course of the tubular loops in the direction of flow of the coolant is provided over a predefined length, with the predefined length of the tubular loop in combination with its flow cross-section forming a buffer volume by which an overflow of liquid coolant into the outlet tube is prevented. Each tubular loop section with an ascending course is able to store liquid coolant and simultaneously to let gaseous coolant which is forcing its way in to sweep away over the liquid or to bubble through it, so that the liquid coolant remains trapped in the ascending section and does not reach the outlet tube. This significantly increases the storage capacity of the tubular evaporator for liquid coolant, and the danger of liquid coolant being expelled into the suction line is correspondingly reduced.

With the same throughflow cross section of the tubular loops and of the outlet tube it is especially advantageous for the tubular loops, over a least a length corresponding to the length of the outlet tube, to have an ascending course in the direction of flow of the coolant.

If each tubular loop, in a manner known per se, features two straight sections of tube joined by one curved section, in accordance with a first embodiment there can be provision for the straight sections of group of tubular loops situated furthest downstream to run in parallel with each other at an angle. This means that of the two parallel straight tube sections of each loop, one is in a position to store liquid coolant.

Preferably the section situated further downstream of the two straight sections of each tubular loop of the group has the course which ascends in the direction of flow of the coolant.

In accordance with a second embodiment in a group of tubular sections situated furthest downstream, both straight tube sections in each case ascend in the direction of flow of the coolant. Thus each straight tube section is in a position to trap liquid coolant and the amount which is allotted to an individual section is small. The smaller this amount is, the stronger the stream of gaseous coolant can be which can flow through the tube section without forcing out the liquid coolant.

In order to implement a high storage capacity the group should comprise a plurality of tubular loops embodied as described above; preferably all tubular loops of the evaporator belong to the group.

The difference in height between the two ends of each straight tube section preferably corresponds at most to half its average distance from adjacent straight tube sections.

BRIEF DESCRIPTION OF THE DRAWINGS

Further features and advantages of the invention emerge from the description of exemplary embodiments given below which refers to the enclosed figures. The figures are as follows.

DETAILED DESCRIPTION OF THE PRESENT INVENTION

Figure 1:
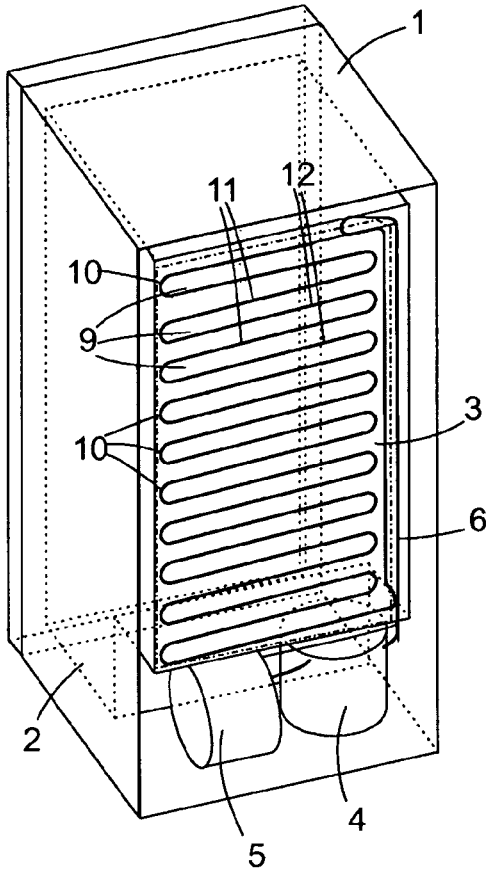
FIG. 1 a schematic view of an inventive refrigeration device.

FIG. 1 shows a schematic view of a refrigeration device, viewed from the rear of the device, with rear wall and insulation layer of a body 1 of the appliance omitted and the other outer surfaces of the body 1 shown as transparent in order to show an inner compartment 2 and a tubular evaporator 3 accommodated on the rear wall of the inner compartment.

In the lower rear area of the inner compartment 2 a niche is cut out in order to form a machinery area which accommodates a compressor 4 and a condenser 5. The compressor 4, the condenser 5 and the tubular evaporator 3 are interconnected to form a coolant circuit.

A suction line 6 extends from an upper right hand corner of the tubular evaporator 3 essentially vertically downwards to the compressor 4. A pressure line 7 goes out from the condenser 5 and runs over a great part of its length within the suction line 6 up to the upper right hand corner of the evaporator 3, where it exits from the suction line 6 again and comes out via choke point 8 into a coolant tube of the evaporator 3. The coolant tube forms a plurality of vertically stepped, series-connected tubular loops 9, each of which has two straight tube sections running in opposite directions connected by a tube bend 10. The upstream tube section of each tubular loop 9 is labeled with the number 11, the downstream section with the number 12. The lowest tube section 12 is connected by an essentially vertical outlet pipe to the suction line 6 at the upper right hand corner of the evaporator.

Figure 2:
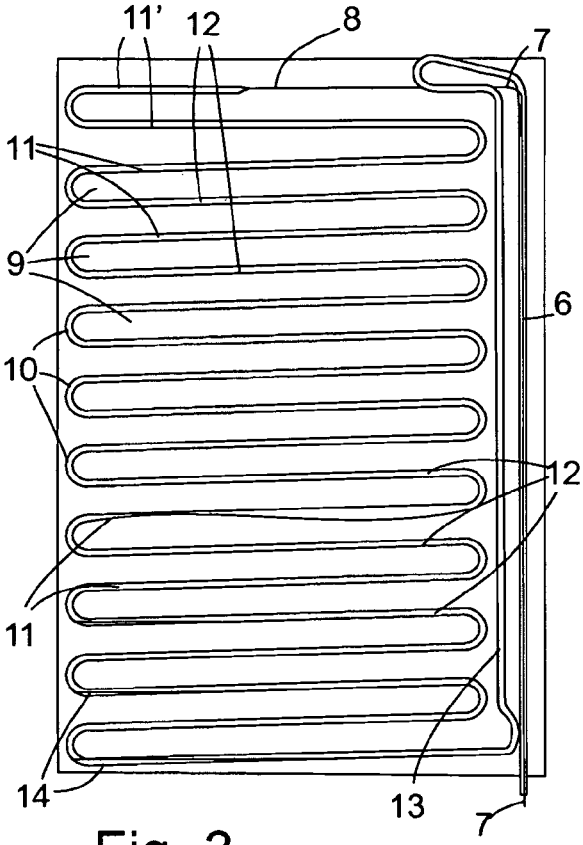
FIG. 2 a section through a tubular evaporator in accordance with a first embodiment of the invention.

As can be seen more clearly in the cross section through the tubular evaporator 3 depicted in FIG. 2, only the furthest upstream tubular loop 9 which directly adjoins the choke point 8 has horizontal straight tube sections 11'. In all other downstream tubular loops 9 the straight tube sections 11, 12 are parallel to each other sloping slightly down towards the side of the evaporator facing away from the suction line 6. This means that a puddle 14 of liquid coolant can collect in each case in the lowest-lying area of each tubular loop 9, at the start of its tube section 12.

If it is assumed that the puddles 14 have a perfectly level liquid surface it can be easily seen that then amount of liquid, which each tube section 12 can hold, without the liquid entirely blocking its cross-section, must be at its greatest when the difference in height between the two ends of the section is slightly smaller than the diameter of the tube section 11. Then the puddle 14 can extend over the entire length of the tube section 12 and fill just about half its volume. If the influence of surface tension on the shape of the liquid surface is negligible, be it as a result of a low surface tension of the coolant or of a large diameter of the coolant tube, it can thus be expedient to choose the difference in height between the ends of each tube section in this way.

If the liquid coolant tends, as a result of its surface tension, to block the free cross section, the falls in sections 11, 12 will sensibly be selected to be somewhat larger, in order to guarantee that the liquid coolant of puddle 14, which would be expelled from the lowest point by the flow of gas onto it, provides sufficiently great resistance to this pressure so that in the course of the tube section 12 the gas can pass the liquid without forcing it downstream. The difference in height can amount here to a few multiples of the tube diameter.

In the one case, as in the other, the tubular loops can hold a significant amount of liquid coolant before the danger arises of this being pushed downstream during an idle phase of the compressor by coolant evaporating further upstream. The coolant circuit can thus be filled with a large amount of coolant without liquid coolant being able to fill the downstream tubular loops 9 to such an extent for it to fill the entire outlet tube 13 connecting the lowest tubular loop to the suction line and get into the suction line 6.

Figure 3:
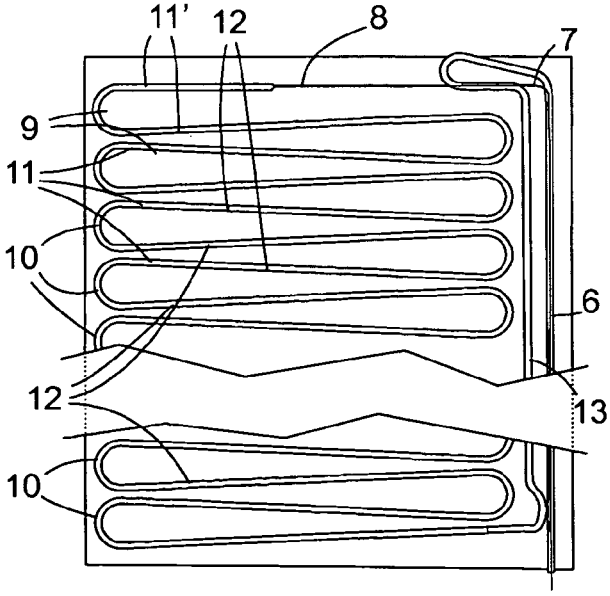
FIG. 3 a fragment of a section through a tubular evaporator similar to that shown in FIG. 2 in accordance with a second embodiment of the invention.

FIG. 3 shows a tubular evaporator 3 as claimed in a second embodiment of the invention. The suction line 6, the pressure line 7 and their course to the choke point 8 are the same as in the first embodiment and thus do not need to be described once again. In this embodiment the two straight tube sections 11, 12 of the tubular loops 9 are not parallel, but both run ascending the direction of flow of the coolant, with the incline being exaggerated in the figure to provide a clearer illustration. This enables the two tube sections 11, 12 of each tubular loop 9 to store liquid coolant, so that the amount of liquid coolant allotted to each tube section is small and the danger of the liquid coolant being forced downstream by evaporation occurring further upstream is reduced even further.

It is obvious that—depending on the filling of the coolant circuit with coolant—it may not be necessary to embody all tubular loops with ascending tube sections, in order to trap any liquid coolant which may arise in the idle phase of the compressor. Tubular loops with conventional horizontal tube sections and those with ascending tube sections can thus be combined in a evaporator, in which case the tubular loops with ascending tube sections should be provided in the downstream part of the evaporator, in order to be able to trap and to hold liquid coolant running out of upstream horizontal tube sections.

The invention claimed is:

1. A refrigerating device comprising:

a tubular evaporator including a carrier plate and a coolant tube arranged thereon in heat-conducting contact;

a suction line; and a compressor; the coolant tube being connected via the suction line to the compressor; the coolant tube being formed by a plurality of series-connected tubular loops and an ascending outlet tube connecting the furthest downstream of the tubular loops to the suction line; wherein the tubular loops are formed with at least one curved section, and at least two generally linear sections extending outwardly therefrom, with at least one of the generally linear sections rising along a horizontally extending path between the at least one curved section and a curved section of a succeeding tubular loop, wherein the succeeding curved section is vertically and horizontally displaced from the at least one preceding curved section and wherein at least one linear section defines an ascending course in the direction of coolant flow, by which in combination with the flow cross-section of the tubular loops a receiving volume is embodied which is able to buffer the liquid coolant.

2. The refrigerating device as claimed in claim 1, wherein the tubular loops have an ascending course in the direction of coolant flow over a length corresponding at least to a length of the outlet tube.

3. The refrigerating device as claimed in claim 1, wherein each tubular loop includes two straight tube sections connected by a curved section.

4. The refrigerating device as claimed in claim 3, wherein the straight sections of a furthest downstream group of the tubular loops run in parallel to each other at an angle.

5. The refrigerating device as claimed in claim 4, wherein, of the at least two linear sections of each tubular loop, the section situated downstream has the course which ascends in the direction of flow of the coolant.

6. The refrigerating device as claimed in claim 3, wherein the linear sections of a group of tubular loops situated furthest downstream each ascend in the direction of flow of the coolant.

7. The refrigerating device as claimed in claim 6, wherein the group includes a plurality of tubular loops.

8. The refrigerating device as claimed in claim 7, wherein the group comprises all of the tubular loops.

9. The refrigerating device as claimed in one of the claims 3, wherein the difference in height between the two ends of each linear tube section corresponds at most to half the average distance to adjacent linear tube sections.

* * * * *